US005114825A

United States Patent [19]

Takizawa et al.

[11] Patent Number: 5,114,825

[45] Date of Patent: May 19, 1992

[54] SUBSTRATES FOR PS PLATES

[75] Inventors: Kazushige Takizawa; Hirokazu Sakaki, both of Shizuoka, Japan

[73] Assignee: Fuji Photo Film Co., Ltd., Minami-Ashigari, Japan

[21] Appl. No.: 361,430

[22] Filed: Jun. 5, 1989

[30] Foreign Application Priority Data

Jun. 6, 1988 [JP] Japan ..... 63-138675

[51] Int. Cl.[5] ..... G03C 1/52; G03C 1/495; C25F 3/04

[52] U.S. Cl. ..... 430/159; 430/157; 430/278; 428/469; 204/129.1; 204/129.4; 204/129.75; 205/201; 205/214; 205/325

[58] Field of Search ..... 204/129.1, 129.4, 129.43, 204/33, 129.75, 27, 38.3; 428/469; 430/278, 157, 159

[56] References Cited

U.S. PATENT DOCUMENTS 4,294,672 10/1981 Ohba et al. ..... 204/129.4
4,476,006 10/1984 Ohba et al. ..... 204/129.4 X
4,482,434 11/1984 Pliefke ..... 204/129.4 X
4,482,444 11/1984 Frass et al. ..... 204/129.4 X
4,822,715 4/1989 Shoji et al. ..... 430/278 X
4,945,004 7/1990 Sprintschnik et al. ..... 428/469

*Primary Examiner*—Donald R. Valentine
*Attorney, Agent, or Firm*—Burns, Doane, Swecker & Mathis

[57] ABSTRACT

An aluminum alloy substrate for presensitized plates for use in making lithographic printing plates comprises an aluminum alloy plate composed of not less than 0.05% by weight and less than 0.5% by weight of Si; 0.2 to 0.7% by weight of Fe; 0.3 to 1.5% by weight of Mn; less than 0.5% by weight of Cu; and the balance of aluminum and unavoidable impurities, the surface of the aluminum alloy plate being subjected to electrolytic graining treatment. The aluminum alloy substrates for PS plates are favorable for appropriate electrolytic graining treatment and show good printing properties and sufficient strength suitable for high-speed printing operation.

16 Claims, 1 Drawing Sheet (×1500)

(×1500)

(×1500)

SUBSTRATES FOR PS PLATES

BACKGROUND OF THE INVENTION

The present invention relates to a substrate for presensitized plates for use in making lithographic printing plates (herinafter referred to as "PS plate" for simplicity) and more particularly to an aluminum alloy plate used as a substrate for PS plates, which is excellent in processability by electrolytic graining and strength and which is less expensive.

Generally, as substrates for PS plates there have conventionally been used aluminum plates. In such cases, it is necessary to roughen the surface of the aluminum plates in order to improve adhesion thereof to light-sensitive films to be applied and water retention property of non-image areas of the plate.

As such surface roughening treatments, there have been known such mechanical surface graining methods as a ball graining technique, a brush graining technique and a wire graining technique, but recently there have also been adopted an electrolytic surface graining method in which the surface of an aluminum plate is electrochemically roughened using an electrolyte such as those consisting of hydrochloric acid or mainly composed of hydrochloric acid (hereinafter referred to as "hydrochloric acid type electrolytes") or those consisting of nitric acid or mainly composed of nitric acid (hereunder referred to as "nitric acid type electrolytes"). The advance of this electrolytic graining technique has recently been accelerated because it is excellent in plate-making properties and printing properties and it is also favorable for continuous processing of coiled materials.

As substrates for PS plates, there have been employed conventionally, in mechanical surface graining methods, aluminum alloy plates corresponding to A 1100 (purity of aluminum: not less than 99.0% by weight) and A 3003 (purity of aluminum: 98.0 to 98.5% by weight) of JIS standard while, in electrolytic graining methods, those corresponding to A 1050 (purity of aluminum: not less than 99.5% by weight) which provide uniform electrolytically grained surfaces.

However, the foregoing aluminum material A 1050 which is favorable for electrolytic surface graining has low strength because of its high purity of aluminum. Therefore, if its thickness is reduced, the resulting plate is hard to handle and this problem becomes conspicuous in particular when it is subjected to burning in treatment since the plate softens during such treatment. For instance, the printing speed has become high in response to the progress of printing techniques and this leads to increase in stress applied to original printing plates which are mechanically fixed at both ends of the plate cylinder of a printing press. Therefore, the fixed portions of the plate sometimes cause deformation or breakage due to insufficient strength of substrates for lithographic printing plate, which in turn causes troubles such as slippage of images and cutting off of the plate which make the printing operation impracticable. Moreover, it is inevitable to use a relatively thick aluminum alloy plate to ensure mechanical strength such as dimensional stability. This is a primary cause of increase in the cost for manufacturing lithographic printing plates.

As materials for substrate of PS plates disclosed in prior art there have been known aluminum alloys listed below:

| Sources and Materials Disclosed Therein | Alloy Composition (wt %) | | | | | | | | |
|---|---|---|---|---|---|---|---|---|---|
| | Si | Fe | Cu | Mn | Mg | Cr | Zn | Ti | Other Component |
| J. P. KOKAI No. 57-89497 (U.S. Pat. No. 4,383,897) | | | | | | | | | |
| 1100 | 0.375 | 0.375 | 0.05 | — | — | — | — | — | |
| 3003 | 0.2 | 0.15 | 0.05 | 0.7 | — | — | 0.2 | 0.2 | |
| A19 | 0.375 | 0.375 | 0.05 | — | 0.9 | — | — | — | |
| J. P. KOKAI No. 54-128453 (U.S. Pat. No. 4,211,619) | | | | | | | | | |
| DIN3.0255 | 0.3 | 0.5 | 0.02 | — | — | — | 0.07 | 0.03 | alloy elements max. 0.5 |
| DIN3.0515 | 0.5 | 0.5 | 0.1 | 0.8~1.5 | 0~0.3 | — | 0.2 | 0.2 | alloy elements max. 1.5 |
| J. P. KOKAI No. 54-133903 (U.S. Pat. No. 4,301,229) | | | | | | | | | |
| 1S | 0.25 | — | — | — | — | — | — | — | |
| 2S | 0.4 | — | — | — | 0.6 | — | — | — | |
| 3S | — | — | — | 1.2 | — | — | — | — | |
| 24S | — | — | 4.5 | 0.6 | 1.5 | — | — | — | |
| 52S | — | — | — | — | 2.5 | 0.25 | — | — | |
| 61S | 0.6 | — | 0.25 | — | 1.0 | 0.25 | — | — | |
| 75S | — | — | 1.60 | — | 2.50 | 0.30 | 5.60 | — | |
| DE1160639 | 0.8~1.2 | 0.5 | 1.4~1.6 | 0.5~0.9 | 0.8~1.2 | — | 0.1~0.3 | — | |
| DE1929146 (U.S. Pat. No. 3,672,878) (U.S. Pat. No. 3,717,915) | 0.2~0.4 | 0.5 | 0.05~0.3 | 0.8~1.4 | 0.8~2.5 | — | 0.01~0.2 | 0.01~0.05 | B = 0.001~0.005 |
| DE2537819 | 0.5~1.5 | 0.05~0.5 | 0~0.5 | 0.005~0.4 | 0.4~1.2 | 0~0.3 | 0~0.5 | 0~0.05 | B = 0~0.005 |
| J. P. KOKAI | 0.05~0.30 | 0.15~0.30 | max. 0.05 | — | 0.05~0.30 | — | — | max. 0.03 | B = max. 0.01 |

-continued

| Sources and Materials Disclosed Therein | Alloy Composition (wt %) | | | | | | | | |
|---|---|---|---|---|---|---|---|---|---|
| | Si | Fe | Cu | Mn | Mg | Cr | Zn | Ti | Other Component |
| No. 58-42745 (U.S. Pat. No. 4,435,230) | | | | | | | | | |
| J. P. KOKAI No. 58-221254 (E.P. 97318A) | 0.02~0.15 | 0.1~1.0 | max. 0.003 | max. 0.05 | max. 0.05 | — | max. 0.05 | max. 0.03 | |
| J. P. KOKAI No. 60-63340 | max. 0.5 | 0.05~0.8 | 0.05~1 | 0.3~2 | max. 1 | — | — | max. 0.05 | |
| J. P. KOKAI No. 60-230951 (U.S. Pat. No. 4,686,083) | max. 0.20 | max. 0.50 | — | 0.05~less than 1.0 | — | — | — | max. 0.1 | |
| J. P. KOKAI No. 61-35995 (U.S. Pat. No. 4,672,022) | max. 0.1 | 1.2~2.1 | max. 0.3 | 0.1~0.9 | max. 0.1 | max. 0.05 | max. 0.1 | max. 0.1 | Fe + Mn = 1.3~2.2 |

"J. P. KOKAI" means "Japanese Patent Un-examined Publication".
In this Table, (—) means that there is no disclosure in the corresponding Prior Art.

Among the aluminum alloys listed in the foregoing Table, particularly favorable for electrolytic surface graining are those having an aluminum purity of not less than 99.9% by weight, preferably not less than 99.5% by weight.

On the other hand, those having an aluminum content of less than 99.0% by weight show high strength, but are inferior in electrolytic surface graining properties.

SUMMARY OF THE INVENTION

An object of the present invention is to provide a substrate for PS plates which does not suffer from the foregoing problems associated with the conventional materials for substrates, more specifically to provide an aluminum alloy substrate for PS plates which has been electrolytically surface grained so as to meet the requirements for substrates for PS plates and which has good printing properties and sufficient strength favorable for high-speed printing.

The foregoing and other objects of the present invention can effectively be achieved by providing an aluminum alloy substrate for PS plates which comprises an aluminum alloy plate composed of not less than 0.2% by weight and less than 0.5% by weight of Si; 0.2 to 0.7% by weight of Fe; 0.3 to 1.5% by weight of Mn; less than 0.05% by weight of Cu; and the balance of aluminum and unavoidable impurities, the surface of the aluminum alloy plate being subjected to electrolytic graining treatment.

According to another aspect of the present invention, the objects of the present invention can also be effectively achieved by providing an aluminum alloy substrate for PS plates which comprises an aluminum alloy plate composed of 0.05 to 0.2% by weight of Si; 0.2 to 0.7% by weight of Fe; 1.0 to 1.5% by weight of Mn; less than 0.05% by weight of Cu; and the balance of aluminum and unavoidable impurities, the surface of the aluminum alloy plate being subjected to electrolytic graining treatment.

DETAILED DESCRIPTION OF THE INVENTION

Figure 1:
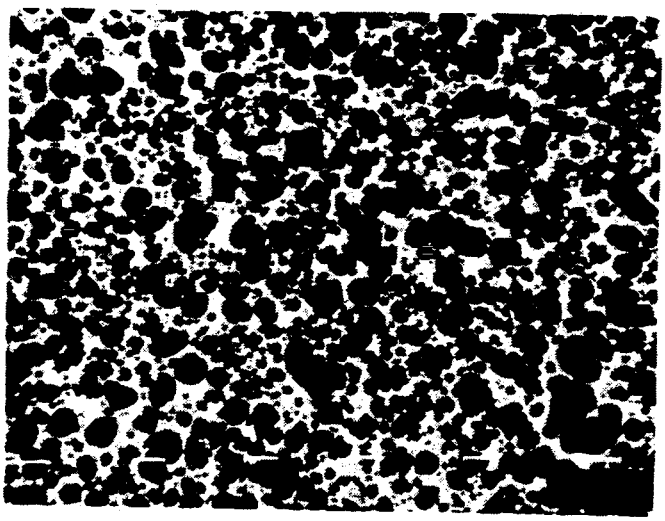
FIG. 1 is an electron photomicrograph of the surface of Sample No. 1 which is electrolytically grained in a nitric acid type electrolyte to form micropits thereon.
Figure 2:
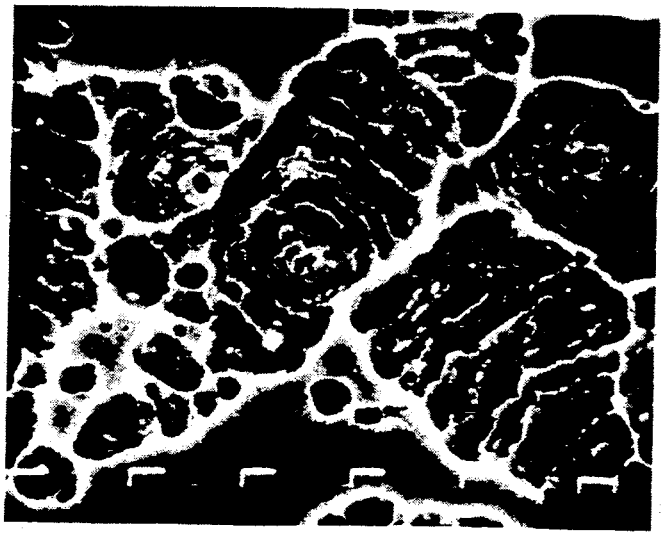
FIG. 2 is an electron photomicrograph of the surface of Sample No. 6 which is electrolytically grained in a nitric acid type electrolyte to form non-uniform macropits thereon.

If aluminum alloy plates other than 1S and DIN 3.0255 as well as those disclosed in J. P. KOKAI Nos. Sho 58-42745 (U.S. Pat. No. 4,434,230), Sho 58-221254(E. P. 97318A) and Sho 60-230951(U.S. Pat. No. 4,686,083) are used upon electrolytically graining the surface of an aluminum alloy plate, non-uniform gross pits (macropits) are liable to be formed and these macropits exert adverse influences on printing properties and printing durability of the resulting lithographic printing plates.

The inventors of this invention have conducted careful analysis of the causes of formation of non-uniform macropits and have found that they are formed due to the presence of Cu occluded in aluminum phase. More specifically, the inventors have found that quite uniform fine pits (micropits) are formed by producing aluminum plates from a variety of aluminum alloys such as JISA 1100, JISA 3003 and JISA 3004 from which Cu is removed and then electrolytically surface graining these aluminum alloy plates in a hydrochloric acid type or nitric acid type electrolyte. In addition, various aluminum alloy plates having different Cu contents were produced by adding Cu to aforesaid aluminum alloys and then electrolytically grained in the same manner as above. As a result, it has been found that if the amount of Cu practically included in each aluminum alloy is substantially limited to less than 0.05% by weight, preferably not more than 0.01% by weight, the pits formed are not non-uniform macropits but uniform micropits.

Moreover, the inventors have also examined influences of other elements of the aluminum alloys and have found that the content of Si should be restricted to not less than 0.05% by weight and less than 0.5% by weight. This is because if it is less than 0.5% by weight, the electrolytic graining treatment is liable to remain un-etched portions on the surface of such aluminum alloy plates. Preferably, uniform etching patterns can be obtained if the content of Si is controlled to not less than 0.2% by weight. On the other hand, if it exceeds 0.5% by weight, the electrolytic graining treatment frequently provides non-uniform grained surface.

The content of Fe should be limited to 0.2 to 0.7% by weight. This is because if it is not more than 0.2% by weight, the strength of the resulting aluminum alloy plate becomes insufficient, while if it exceeds 0.7% by weight, there is observed formation of gross intermetallic compounds which interferes with the electrolytic graining. Preferred strength of the aluminum alloy plates is not less than 15 kg/mm$^2$ expressed in proof stress from the viewpoint of handling properties, fixing properties to a printing press and fatigue strength of the resulting lithographic printing plates. Therefore, the content of Mn is 0.3 to 1.5% by weight for the purposes of improving the strength of the aluminum alloy and obtaining a uniform grained surface by electrolytic graining. If it is less than 0.3% by weight, a desired strength of the aluminum alloy plate cannot be attained while if it exceeds 1.5% by weight, gross intermetallic compounds are formed and non-uniform surfaces are formed by electrolytic graining treatment. Aluminum alloy plates having more preferred strength can be obtained by limiting the content of Mn to not less than 1.0% by weight.

Aluminum alloys are generally comprise Ti as an agent for obtaining fine texture of ingots. The content of Ti is desirably not more than 0.5% by weight since Ti easily causes aggregation of Al-Ti particles and/or Ti-B particles and is liable to make the surface electrolytically grained non-uniform.

Aluminum alloys may further comprise impurity elements such as Cr, Zn and Ni, but these elements do not exert any particular adverse influences on the acceptability of electrolytic graining of the alloys so far as the content of each element is limited to not more than 0.5% by weight.

Aluminum alloys may further comprise not more than 1.3% by weight of Mg. Mg is added to these alloys to improve the strength thereof without exerting any adverse influences on the electrolytic graining. Most of Mg is occluded in the Al phase to increase the strength thereof, but if the content thereof exceeds 1.3% by weight, the rolling properties of the alloys are lowered and the use of Mg in excess makes the surface of the alloys electrolytically grained non-uniform.

The aluminum plates for use as substrates for PS plates, composed of such aluminum alloys, can be subjected to electrolytic graining without forming non-uniform macropits, but with forming uniform micropits. Therefore, these plates show high strength, printing properties and printing durability superior to those of conventional material JISA 1050.

Method for treating the surface of the substrate for PS plates of the present invention will hereunder be explained in more detail.

The method for surface graining as used herein is the electrolytic graining method which comprises passing an alternating current through a substrate to be electrolytically grained in a hydrochloric acid type or nitric acid type electrolyte. In the present invention, the electrolytic graining treatment may be combined with mechanical surface graining methods such as wire brush graining technique in which the surface of an aluminum plate is scratched with a metal wire; ball graining technique in which the aluminum surface is grained with abrasive balls and an abrasive compound; and/or brush graining technique in which the aluminum surface is grained with a nylon brush and an abrasive compound.

Prior to electrolytic graining, the aluminum plates is subjected to a surface treatment for cleaning the surface thereof such as removal of rolling oils adhered to the aluminum surface or the abrasive compounds which bite into the surface (if the surface is subjected to mechanical graining). Generally, solvents such as trichloroethylene or surfactants are used to remove the rolling oils to thus make the surface clean. Alternatively, in order to remove both rolling oils and abrasive compounds biting into the surface, there are generally used methods which comprise dipping an aluminum alloy plate in an aqueous solution such as 1 to 3% aqueous solutions of sodium hydroxide, potassium hydroxide, sodium carbonate and sodium silicate at a temperature of 20° to 80° C. for 5 to 250 seconds and then dipping it in 10 to 30% aqueous solution of nitric acid or sulfuric acid at a temperature of 20° to 70° C. for 5 to 250 seconds to perform neutralization and removal of smuts after the alkali etching.

After such a surface cleaning of the aluminum alloy plates, they are subsequently subjected to electrolytic graining treatment.

When a hydrochloric acid solution is used as the electrolytes for use in the electrolytic graining in the present invention, the concentration thereof preferably ranges from 0.01 to 3% by weight and more preferably 0.05 to 2.5% by weight. Alternatively, if a nitric acid solution is used, its concentration preferably ranges from 0.2 to 5% by weight and more preferably 0.5 to 3% by weight.

The electrolytes may optionally contain corrosion inhibiting agents (or stabilizers) and/or agents for uniformizing grained surface such as nitrates, chlorides, monoamines, diamines, aldehydes, phosphoric acid, chromic acid, boric acid and oxalic acid.

The temperature of the electrolytic in general ranges from 10° to 60° C. during the treatment. The alternating current used in this treatment may be in any wave form such as rectangular wave, trapezoidal wave for sign wave so far as it comprises alternating positive and negative polarities and thus usual commercial single-phase and three-phase alternating current may be used. The current density in the electrolytic graining desirably ranges from 5 to 100 A/dm$^2$ and the treatment is desirably continued for 10 to 300 seconds.

The surface roughness of the aluminum alloy plates used in the present invention is controlled by adjusting the quantity of electricity so that it ranges from 0.2 to 0.8 μm. If it exceeds 0.8 μm, the grained surface is covered with macropits much more than those obtained from the material JISA 1050. This becomes a cause of contamination during printing operation. On the other hand, if it is less than 0.2 μm, the control of the amount of dampening water supplied to the surface of a lithographic printing plate becomes difficult, half tone dot portions of shadowed parts are liable to cause ink-spreading and hence good printed matters cannot be obtained.

The aluminum alloys thus surface grained are treated with 10 to 50% hot sulfuric acid solution (40° to 60° C.) or a dilute alkali solution (such as an aqueous sodium hydroxide solution) to remove smuts adhered to the surface thereof. If the smuts are removed with an alkali, the aluminum alloy plates are subsequently dipped in an acid solution (such as an aqueous sulfuric acid or hydrochloric acid solution) to wash and neutralize the alloy plates.

After desmutting the surface, the aluminum alloy plates are enodized. The anodization may be carried out in a conventionally well known manner, but most useful electrolyte is sulfuric acid. Secondary preferred electrolyte is phosphoric acid. Moreover, the method using a mixed acid of sulfuric acid and phosphoric acid as an electrolyte as disclosed in J. P. KOKAI No. 55-28400(U.S. Pat. No. 4,229,226) is also a useful means.

In the sulfuric acid method, the treatment is generally performed using direct current, but alternating current may also be used. Sulfuric acid is used in a concentration ranging from 5 to 30% by weight and the aluminum alloy plates are electrolyzed at 20° to 60° C. for 5 to 250 seconds so as to form an anodized layer on the alloy plates in an amount ranging from 1 to 10 g/m$^2$. Moreover, the current density during the anodization preferably ranges from 1 to 20 A/dm$^2$. In the phosphoric acid method, the concentration of phosphoric acid is 5 to 50% by weight and the aluminum alloy plates are electrolyzed at 30° to 60° C. for 10 to 300 seconds at a current density of 1 to 15 A/dm$^2$.

After making the anodized layer, the aluminum alloy plates may optionally be subjected to a post-treatment. For instance, the post-treatment may be performed in accordance with a method as disclosed in U.K. Patent No. 1,230,447 which comprises dipping the plates in an aqueous solution of polyvinylsulfonic acid or a method as disclosed in U.S. Pat. No. 3,181,461 which comprises dipping the plates in an aqueous solution of an alkali metal silicate. An underlying coating of a hydrophilic polymer may optionally be applied to the surface of the plates, but whether the underlying coating should be applied or not is determined depending on properties of the light-sensitive materials to subsequently be applied thereto.

The light-sensitive layers exemplified below can be applied to the surface of the substrates of the present invention thus produced to prepare PS plates.

(I) Light-sensitive Layer Comprising an o-Naphthoquinonediazido-sulfonate of a Polyhydric Polymeric Compound and a Mixed Phenol. Cresol Novolak Resin As the polyhydric polymeric compounds, there may be used those having an average molecular weight ranging from 1,000 to 7,000 and examples thereof include polycondensed products of phenol compounds having at least two hydroxy groups on, for instance, the benzene ring such as resorcinol and pyrogallol; and aldehyde compounds such as formalin and benzaldehyde. In addition to these compounds, there may further be mentioned, for instance, phenol-formaldehyde resins, cresol-formaldehyde resins, p-tert-butylphenol-formaldehyde resins and phenol-modified xylene resins. On the other hand, examples of preferred novolak resins include phenol-m-cresol-formaldehyde novolak resins as disclosed in J. P. KOKAI No. 55-57851 which are novolak resins containing phenol moiety having a relatively high molecular weight. In addition, to form visible images through exposure to light, the light-sensitive layer may comprise a compound which generates a Lewis acid by the action of light, such as o-naphthoquinonediazido-4-sulfonyl chloride, an inorganic anionic salt of p-diazodiphenylamine, a trihalomethyl oxadiazole compound and a trihalomethyl oxadiazole compound having a benzofuran ring. The light-sensitive layer may further comprise dyes such triphenylmethane dyes as Victoria Pure Blue BOH, Crystal Violet and Oil Blue.

The light-sensitive composition comprising the components explained above is applied to the surface of the substrate of this invention is an amount ranging from 0.5 to 3.0 g/m$^2$ expressed in dry weight to prepare a PS plate.

(II) Light-sensitive Layer Composed of Diazo resins and Water-insoluble and Lipophilic Polymeric Compounds The aluminum alloy plate is dipped in an alkali metal silicate bath as disclosed in U.S. Pat. No. 3,181,461 after making an anodized layer as explained above. It is preferred to apply, to the surface thus treated, a light-sensitive layer composed of a $PF_6$ salt or a $BF_4$ salt of diazo resin, an organic salt of diazo resin and a water-insoluble and lipophilic polymeric compound. If such a light-sensitive layer is formed on the surface of the substrate of the present invention, there can be obtained a PS plate excellent in storage stability, which provides good visible images after development and is stable even under severe conditions such as high temperature and high humidity conditions.

The diazo resins used herein are $PF_6$ salts or $BF_4$ salts and organic salts thereof and examples thereof are such aromatic sulfonic acids as triisopropylnaphthalene-sulfonic acid, 4,4'-biphenyldisulfonic acid, 5-sulfosalicylic acid, 2,5-dimethylbenzenesulfonic acid, p-dodecylbenzene sulfonic acid and p-toluenesulfonic acid; and such hydroxyl group-containing aromatic sulfonic acids as 2-hydroxy-4-methoxybenzophenone-5-sulfonic acid.

On the other hand, the polymeric compounds having hydroxyl groups are those having weight-average molecular weight ranging from 5,000 to 500,000 and examples thereof include:

(1) Copolymers of, for instance, N-(4-hydroxyphenyl)acrylamide, N-(4-hydroxyphenyl)methacrylamide or N-(4-hydroxynaphthyl)methacrylamide with other monomers; and (2) Copolymers of, for instance, o-, m- or p-hydroxyphenyl methacrylate and other monomers.

Examples of the foregoing other monomers include:

(i) $\alpha$, $\beta$-unsaturated carboxylic acids such as acrylic acid, methacrylic acid and maleic anhydride;

(ii) alkyl acrylates such as methyl acrylate and ethyl acrylate;

(iii) alkyl methacrylates such as methyl methacrylate and ethyl methacrylate;

(iv) acrylamides or methacrylamides such as acrylamide and methacrylamide;

(v) vinyl ethers such as ethyl vinyl ether and hydroxyethyl vinyl ether;

(vi) styrenes such as styrene and $\alpha$-methylstyrene;

(vii) vinyl ketones such as methyl vinyl ketone;

(viii) olefins such as ethylene, propylene and isoprene; and (ix) N-vinyl pyrrolidone, N-vinyl carbazole, acrylonitrile and methacrylonitrile.

The foregoing other monomers are not restricted to specific ones listed above and any other monomers may be used so far as they can be copolymerizable with the monomers having aromatic hydroxyl groups.

The light-sensitive layer may also contain oil-soluble dyes. Preferred examples thereof include Victoria Pure Blue BOH, Crystal Violet Victoria Blue, Methyl Violet and Oil Blue #603. To obtain light-sensitive layers having the composition discussed above, a composition containing the foregoing components is applied to the surface of the substrate of the present invention after adding other optional additives such as fluorine-atom containing surfactants, nonionic surfactants, plasticizers (e.g., dibutyl phthalate, polyethylene glycol, diethyl phthalate and trioctyl phosphate) and known stabilizers (e.g., phosphoric acid, phosphorous acid and organic acids) so that the coated amount thereof weighed after drying ranges from 0.5 to 2.5 g/m$^2$.

(III) Light-sensitive Layer Composed of A Photopolymerizable Light-sensitive Composition Which Comprises A Polymer Having Carboxylic Acid Residues or Carboxylic Anhydride Residues, An Addition Polymerizable Unsaturated Compound and A Photopolymerization Initiator.

In the case of photopolymerizable light-sensitive materials, it is preferred that the surface of a substrate which has been grained in a hydrochloric acid bath be anodized in a phosphoric acid electrolyte or an electrolyte of a mixture of phosphoric acid and sulfuric acid. After anodizing the substrate in phosphoric acid bath and then treating with a silicate solution, the surface of the substrate is coated with a photopolymerizable light-sensitive composition which comprises a polymer having carboxylic acid residues or carboxylic anhydride residues, an addition polymerizable unsaturated compound and a photopolymerization initiator to form a light-sensitive layer. Moreover, the substrate of the present invention may be used for preparing a PS plate to which an electrophotographic light-sensitive material is applied, as disclosed in J. P. KOKAI No. 60-107042.

The lithographic printing plates thus prepared show good storability, the exposed surface of the aluminum plate at non-image areas is not stained with a printing ink and has good hydrophilicity favorable for rapidly removing attached printing ink and the surface has high adhesion to the light-sensitive layer.

Preferred examples of the polymers having carboxylic acid residues or carboxylic anhydrides residues favorable for this purpose are those having repeating units selected from the group consisting of those represented by the following formulas (A) to (D):

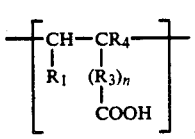
[A]

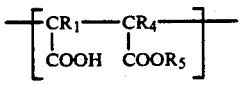
[B]

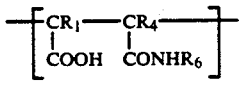
[C]

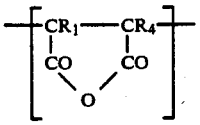
[D]

In the general formulas (A) to (D), $R_1$ and $R_4$ each represents a hydrogen atom or an alkyl group; $R_3$ represents a phenylene group on an alkylene group optionally having a hydroxyl group; $R_5$ represents a hydrogen atom or an alkyl group optionally having substituents; $R_6$ represents an alkyl, allyl, aryl or cycloalkyl group which may have substituents; and n is an integer of 0 or 1.

More specifically, examples of the repeating units represented by formula (A) are those derived from acrylic acid, methacrylic acid, crotonic acid and vinyl benzoic acid; examples of the repeating units represented by formula (B) those derived from maleic acid, maleic acid monohydroxyalkyl ester and maleic acid monocyclohexyl ester; examples of the repeating units of formula (C) those derived from maleic acid monoalkylamide and maleic acid monohydroxyalkylamide; and examples of the repeating units represented by formula (D) those derived from maleic anhydride and itaconic anhydride. As the polymers, those having an average molecular weight ranging from 1,000 to 100,000 are usually used in the invention.

The addition polymerizable unsaturated compounds herein mean monomers having ethylenically unsaturated double bonds which can cause addition polymerization between them in the three-dimensional direction when the photopolymerizable light-sensitive composition is irradiated with actinic rays. Examples thereof are unsaturated carboxylic acids, esters of unsaturated carboxylic acids and aliphatic polyhydric compounds and esters of unsaturated carboxylic acids and aromatic polyhydric compounds.

As the photopolymerization initiators, there may be mentioned, for instance, benzoin, benzoin alkyl ether, benzophenone, anthraquinone and Michler's ketones which may be used alone or in combination in an amount ranging from 1 to 3 g/m$^2$ (weighed after drying).

The present invention will hereunder be explained in more detail with reference to the following non-limitative working Examples and the effect practically achieved by the present invention will also be discussed in detail in comparison with Comparative Examples.

All percents are by weight unless otherwise indicated.

EXAMPLES AND COMPARATIVE EXAMPLES

Aluminum alloys (Sample Nos. 1 to 10) having compositions summarized in Table I were melted and casted, followed by repeating hot rolling, cold rolling and intermediate annealing process to obtain aluminum alloy plates as substrates for PS plates having a thickness of 0.30 mm. Then the plates were treated with 10% sodium hydroxide solution to remove the rolling oil adhered to the surface thereof, neutralized and washed with 20% nitric acid solution at 20° C. and electrolyzed at 50° C. for 10 seconds in 1% hydrochloric acid type electrolyte or 1% nitric acid type electrolyte using an alternating current at a current density of 30 A/dm$^2$.

Then the plates were immersed in 15% aqueous sulfuric acid solution maintained at 50° C. for 3 minutes to make the surface thereof clean and were anodized at 30° C. in an electrolyte mainly composed of 20% sulfuric acid to form 3 g/dm$^2$ of an anodized layer.

A light-sensitive composition having the following composition was applied to the surface of Samples thus prepared so that the coated amount thereof was 2.5 g/m$^2$ (weighed after drying) to thus prepare PS plates.

| Components | Amount (part by weight) |
|---|---|
| Ester compound of naphthoquinone(1,2)- | 1 |

-continued

| Components | Amount (part by weight) |
|---|---|
| diazido-(2)-5-sulfonic acid chloride and resorcinbenzaldehyde resin | |
| Co-polycondensed resin of phenol; m-, p-mixed cresol; and formaldehyde | 3.5 |
| 2-Trichloromethyl-5-(β-(2'-benzofuryl)vinyl)-1,3,4-oxadiazole | 0.03 |
| Victoria Pure Blue BOH (available from HODOGAYA CHEMICAL CO., LTD.) | 0.1 |
| o-Naphthoquinonediazidosulfonic acid ester of p-butylphenol-benzaldehyde novolak resin | 0.05 |
| Methyl cellosolve | 27 |

The resulting PS plates were exposed to light from a 3 KW metal halide lamp disposed at a distance 1 m from the plates for 50 seconds and were developed with 4% aqueous solution of sodium metasilicate at 25° C. for 45 seconds to thus prepare lithographic printing plates.

Samples Nos. 1 to 10 were examined on mechanical strength, fatigue strength, heat softening properties and uniformity of the electrolytically grained surface. The results observed are summarized in Table I given below.

Test Method (1) Uniformity of the Electrolytically Grained Surface

The state of the surface was observed by a scanning electron microscope to evaluate the uniformity of pits on the surface according to the following two-stage evaluation:

A: Uniform micropits are formed;

B: Non-uniform macropits are formed.

(2) Fatigue Strength

A test piece of 20 mm wide and 100 mm long was cut out from each Sample, one end thereof was fixed to a fixing tool, the specimen was bent towards upward direction at an angle of 30° and then returned to the original position (one cycle). The cycles were repeated to determine the number of cycles required for finally breaking off the specimen.

(3) Heat Softening Properties

Samples were heated to 300° C. for 7 minutes in a burning processor 1300 (Burning Processor equipped with a 12 KW heat source, available from Fuji Photo Film Co., Ltd.). After cooling, JIS No. 5 test pieces were prepared and 0.2% proof stress of the specimens was determined by tensile test.

TABLE I

| | Sample No. | Composition (wt %) Si | Fe | Cu | Mn | Mg | Zn | Ti | Al | Mechanical Strength: Tensile Strength (kgf/mm²) | Proof Stress (kgf/mm²) | Elongation (%) |
|---|---|---|---|---|---|---|---|---|---|---|---|---|
| Aluminum Alloy of the Invention | 1 | 0.25 | 0.54 | 0.01 | 1.06 | 0.00 | 0.01 | 0.02 | 98.11 | 20.3 | 20.1 | 3 |
| | 2 | 0.22 | 0.36 | 0.00 | 0.95 | 0.00 | 0.00 | 0.02 | 99.35 | 17.2 | 16.8 | 2 |
| | 3 | 0.28 | 0.40 | 0.01 | 1.05 | 1.14 | 0.04 | 0.03 | 97.01 | 25.9 | 22.6 | 6 |
| | 4 | 0.42 | 0.60 | 0.01 | 0.90 | 0.00 | 0.00 | 0.02 | 99.14 | 17.4 | 17.2 | 2 |
| | 5 | 0.08 | 0.32 | 0.01 | 1.10 | 0.00 | 0.00 | 0.02 | 98.47 | 23.0 | 22.1 | 3 |
| Aluminum Alloy of Comparative Ex. | 6 | 0.25 | 0.54 | 0.14 | 1.06 | 0.00 | 0.00 | 0.02 | 97.99 | 20.8 | 20.4 | 3 |
| | 7 | 0.22 | 0.36 | 0.13 | 0.95 | 0.00 | 0.00 | 0.02 | 99.21 | 17.9 | 17.3 | 2 |
| | 8 | 0.28 | 0.40 | 0.24 | 1.05 | 1.14 | 0.04 | 0.03 | 96.78 | 26.8 | 23.7 | 6 |
| | 9 | 0.42 | 0.60 | 0.05 | 0.90 | 0.00 | 0.00 | 0.03 | 98.13 | 17.4 | 17.1 | 2 |
| | 10 | 0.08 | 0.32 | 0.00 | 0.00 | 0.00 | 0.00 | 0.02 | 99.58 | 15.0 | 14.2 | 2 |

| | Sample No. | Fatigue Strength (× 10³): Fixed Along Longitudinal Direction | Fixed Along Widthwise Direction | Heat Softening Properties (proof stress kgf/mm²) | Uniformity of Electrolytically Grained Surface*: HCl type Electrolyte | HNO₃ type Electrolyte |
|---|---|---|---|---|---|---|
| Aluminum Alloy of the Invention | 1 | 74 | 56 | 15.3 | A | A |
| | 2 | 49 | 36 | 14.1 | A | A |
| | 3 | 92 | 68 | 19.3 | A | A |
| | 4 | 50 | 39 | 14.1 | A | A |
| | 5 | 83 | 71 | 18.3 | A | A |
| Aluminum Alloy of Comparative Ex. | 6 | 70 | 51 | 16.0 | B | B |
| | 7 | 56 | 40 | 14.8 | B | B |
| | 8 | 93 | 69 | 20.0 | B | B |
| | 9 | 50 | 39 | 14.3 | B | B |
| | 10 | 20 | 18 | 8.2 | A | A |

*A: Uniform micropits are formed
B: Non-uniform macropits are formed

As seen from the results listed in Table I, Sample Nos. 1 to 5 and No. 10 which comprise not more than 0.01% by weight of Cu form uniform micropits after the electrolytic etching, while Sample Nos. 6 to 9 which comprise not less than 0.02% by weight of Cu form non-uniform macropits.

Moreover, the materials of the present invention (Samples Nos. 1 to 5) are superior in either of mechanical strength, fatigue strength and heat softening properties to those of the comparative material (Sample No. 10).

The aluminum alloy substrates for PS plates according to the present invention are favorable for appropriate electrolytic graining treatment and show good printing properties and sufficient strength suitable for high-speed printing operation.

What is claimed is:

1. An aluminum alloy substrate for presensitized plates for use in making lithographic printing plates comprising an aluminum alloy plate composed of 0.22 to 0.5% by weight of Si; 0.2 to 0.7% by weight of Fe; 0.3 to 1.5% by weight of Mn; less than 0.05% by weight of Cu; an amount of Ti not more than 0.05% by weight; and the balance of aluminum and unavoidable impurities, the surface of the aluminum alloy plate being subjected to electrolytic graining treatment.

2. The aluminum alloy substrate of claim 1 wherein the content of Mn ranges from 1.0 to 1.5% by weight.

3. The aluminum alloy substrate of claim 1 wherein the content of each unavoidable impurity is not more than 0.05% by weight.

4. The aluminum alloy substrate of claim 1 wherein it further comprises not more than 1.3% by weight of Mg.

5. A presensitized plate for use in making a lithographic printing plates comprising the aluminum alloy plate as defined in claim 1 having coated thereon a light-sensitive layer.

6. The aluminum alloy substrate of claim 1, wherein the electrolytic graining treatment is carried out in an electrolyte comprising hydrochloric acid or nitric acid using an alternating current.

7. The aluminum alloy substrate of claim 1, wherein the surface of the aluminum alloy plate is further anodized after the electrolytic graining treatment.

8. The aluminum alloy substrate for presensitized plates for use in making lithographic printing plates comprising an aluminum alloy plate including 0.22 to 0.5% by weight of Si; 0.2 to 0.7% by weight of Fe; 0.3 to 1.5% by weight of Mn; less than 0.05% by weight of Cu; not more than 0.05% by weight of Ti; and the balance of aluminum and unavoidable impurities, the surface of the aluminum alloy plate being subjected to electrolytic graining treatment followed by anodic oxidizing treatment.

9. The aluminum alloy substrate of claim 8, wherein the content of Cu is not more than 0.01% by weight.

10. The aluminum alloy substrate of claim 8, wherein the electrolytic graining treatment is carried out in an electrolyte comprising hydrochloric acid or nitric acid using an alternating current.

11. A presensitized plate for use in making lithographic printing plates comprising the aluminum alloy plate as defined in claim 8 having coated thereon a light-sensitive layer.

12. The presensitized plate of claim 11, wherein the electrolytic graining treatment is carried out in an electrolyte comprising hydrochloric acid or nitric acid using an alternating current.

13. The presensitized plate of claim 11, wherein the surface of the aluminum alloy plate is further post-treated with an aqueous solution of an alkali metal silicate.

14. The presensitized plate of claim 13, wherein said light-sensitive layer comprises a light-sensitive diazo resin and a water-insoluble and lipophilic polymeric compound.

15. The presensitized plate of claim 14, wherein said polymeric compound is one having hydroxyl groups and having a weight-average molecular weight ranging from 5,000 to 500,000.

16. An aluminum alloy plates substrate for presensitized plates for use in making lithographic printing plates comprising an aluminum alloy plate including 0.22 to 0.5% by weight of Si; 0.2 to 0.7% by weight of Fe; 0.3 to 1.5% by weight of Mn; not more than 1.3% by weight of Mg; less than 0.05% by weight of Cu; not more than 0.05% by weight Ti; and the balance of aluminum and unavoidable impurities, the surface of the aluminum alloy plate being subjected to electrolytic graining treatment followed by anodic oxidizing treatment.

* * * * *